United States Patent [19]

MacGregor

[11] 4,011,303

[45] Mar. 8, 1977

[54] PROCESS FOR DESULFURIZING SULFUR-BEARING COKE

[75] Inventor: Douglas MacGregor, Salt Lake City, Utah

[73] Assignee: William H. Sayler, Salt Lake City, Utah ; a part interest

[22] Filed: Nov. 12, 1975

[21] Appl. No.: 630,960

Related U.S. Application Data

[63] Continuation of Ser. No. 541,001, Jan. 14, 1975, abandoned.

[52] U.S. Cl. ..... 423/461; 423/444; 201/17

[51] Int. Cl.[2] ..... C01B 31/02; C01B 31/26

[58] Field of Search ..... 423/444, 443, 461; 201/17

[56] References Cited

UNITED STATES PATENTS

| | | | |
|---|---|---|---|
| 2,480,639 | 8/1949 | Ferguson | 423/444 |
| 2,789,037 | 4/1957 | Kimberlin et al. | 423/444 |
| 3,009,781 | 11/1961 | Johnson et al. | 423/444 |
| 3,034,863 | 5/1962 | Johnson et al. | 423/444 |

*Primary Examiner*—Edward J. Meros
*Attorney, Agent, or Firm*—Mallinckrodt & Mallinckrodt

[57] ABSTRACT

Sulfur-bearing coke is desulfurized by heating it and reacting it with dilute sulfur vapor to form carbon disulfide. The reaction will proceed utilizing air-polluting sulfur components in the coke, thereby removing such components to provide a relatively non-polluting coke as a fuel.

6 Claims, 1 Drawing Figure

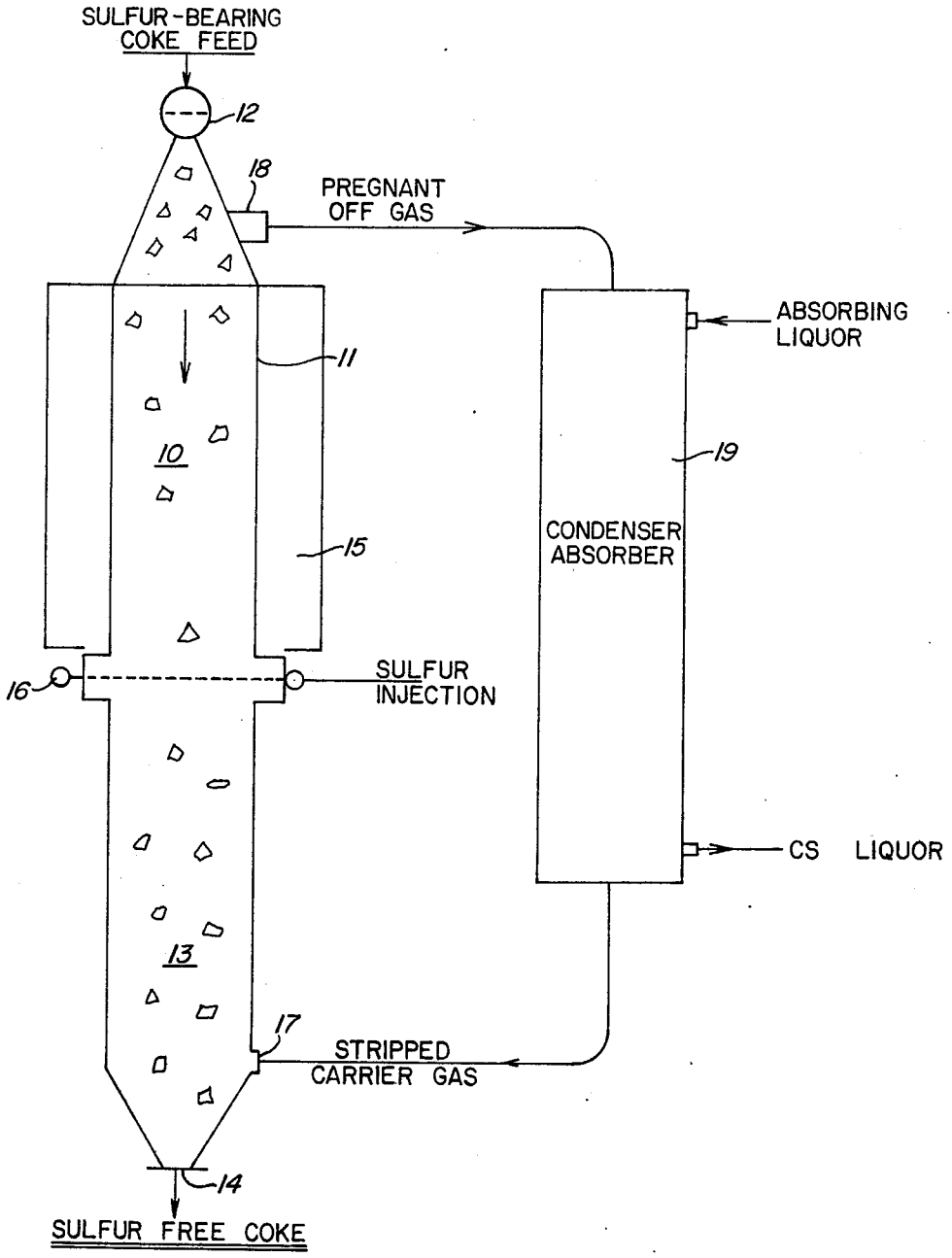
SULFUR-BEARING
COKE FEED
12
18
PREGNANT
OFF GAS
ABSORBING
LIQUOR
11
10
19
CONDENSER
ABSORBER
15
16
SULFUR
INJECTION
CS LIQUOR
13
17
STRIPPED
CARRIER GAS
14
SULFUR FREE COKE

PROCESS FOR DESULFURIZING SULFUR-BEARING COKE

RELATED CASE

This application is a continuation-in-part of my copending application Ser. No. 541,001, filed Jan. 14, 1975, now abandoned.

BACKGROUND OF THE INVENTION

Field

The invention is in the field of processing sulfur-bearing coke for the removal of most, if not all, of the sulfur therefrom.

State of the Art

The present concern about air pollution has led to a number of laws and regulations designed to control the emission of sulfurous gases into the air. Controlling emissions of sulfur in the form of gases is a major problem when coal or coke is burned as a fuel. To do this by removing sulfur from the exhaust gases has proven unsatisfactory both from economic and operational standpoints.

Objectives

It is a primary object of the present invention to provide for the removal, from sulfur-bearing coke, of those sulfur components that would otherwise form air-polluting, sulfurous, stack gases when the coke is burned as a fuel.

SUMMARY OF THE INVENTION

Sulfur-bearing coke is desulfurized by contacting it with a dilute mixture of elemental sulfur vapor and a gas carrier which is substantially inert with respect to the coke being treated, the coke being first heated to a temperature at which it will react with the dilute elemental sulfur vapor to form carbon disulfide. The reaction proceeds utilizing sulfur components of the coke along with the introduced sulfur. Inorganic compounds of sulfur are not removed by this procedure, but, since these do not give rise to air-polluting gases when the coke is burned as a fuel, it is of no consequence. Air polluting forms of sulfur are removed, and this results in a relatively clean-burning fuel product.

The reaction takes place at approximately 1150° F and on up to the dissociation temperature of carbon disulfide. Heating of the coke and reacting it with dilute elemental sulfur vapor may be accomplished in a variety of different types of apparatus. Reaction times will vary, depending upon the type of apparatus employed and the concentration of the sulfur vapor. Sulfur concentrations of between 1% and 10% by volume in an inert gas are preferred. Satisfactory results are usually obtained in one-half to one hour with sulfur vapor concentrations of about 2% to 3%.

The carbon disulfide formed is removed as a vapor and is recovered as a useful by-product by means well known in the art.

THE DRAWING

The single FIGURE in the drawing shows schematically a satisfactory form of furnace and reaction chamber for carrying out the method of the invention.

DETAILED DESCRIPTION OF THE ILLUSTRATED EMBODIMENT

In the illustrated form of apparatus, sulfur-bearing coke is fed into reaction chamber 10 of a reaction vessel 11 through an entryway 12 suitably arranged to prevent the escape of gases. During initial start-up of the apparatus, the coke entering the apparatus will fall through reaction chamber 10 into a lower cooling chamber 13 and will lodge against and build up upon closed exit port 14. Coke will be fed into the apparatus until both cooling chamber 13 and reaction chamber 10 are filled.

Heating means, such as a tubular furnace 15, surrounds reaction chamber 10, the operation being such as will raise the temperature of the coke to a point within the range of preferably 1800°–2200° Fahrenheit and keep it at that temperature for the time required to effect the desired reaction.

Provision is made for introducing dilute elemental sulfur vapor into the reaction chamber so it will permeate the column of coke therein. As illustrated, an inert carrier gas is introduced into the apparatus at or near the bottom of cooling chamber 13 through a port 17. Nitrogen has been found to be particularly satisfactory as the carrier gas. Such carrier gas flows upwardly through the coke in cooling chamber 13, simultaneously cooling the coke and heating the gas. The so-heated gas mixes with elemental sulfur vapor that is injected into the apparatus through a manifold 16 at the bottom of or just below, reaction chamber 10, and both carrier gas and sulfur vapor move upwardly through the heated coke.

Instead of sulfur vapor, sulfur solids, preferably in powder form, may be injected through manifold 16 into the lower part of reaction chamber 10. The sulfur solids are vaporized therein by the heat of the apparatus, the coke material and the carrier gas, and the vapor is carried upwardly through the heated coke in reaction chamber 10, by the carrier gas.

In the reaction chamber, the elemental sulfur reacts with the heated coke to produce carbon disulfide. The general formula for the reaction is:

$$C + 2S = CS_2$$

Carbon for the reaction comes from the coke, while the sulfur comes from both the elemental sulfur introduced into the chamber and sulfur contained by combustible portions of the coke.

It is thought that sulfur exists in three forms in the coke: (1) as a solid solution of sulfur in carbon; (2) as organic sulfur compounds; (3) as inorganic sulfur compounds. The first two are constituents of combustible portions of the coke. Thus, as the coke burns, these sulfur components are released and also burn, forming the various sulfur compounds and gases that are normally found in stack gases and which are a major source of air pollution. The third form of sulfur, the inorganic compounds, exist mainly as sulfates and are not released during burning. They report substantially unchanged in the ash and bear no responsibility for air pollution problems.

The mechanism of the chemical reaction or reactions taking place in the reaction chamber are not known, but it is believed that the first two types of sulfur in the coke are loosely bound to the carbon on a one to one basis, i.e. sulfur atom loosely bound to one carbon atom. The sulfur-carbon complex is a point of reaction which becomes active in the presence of the dilute elemental sulfur vapor when at the high temperature to which the coke is heated. It is thought that one of the sulfur atoms from the sulfur vapor reacts with one sulfur-carbon complex to form carbon disulfide.

If this is the correct reaction, for each sulfur atom removed from the coke, one carbon atom would also be removed. Each carbon atom weighs only 37.5% of the sulfur atom. Thus, if sulfur representing 1% of the weight of the coke were removed, carbon representing 0.375% of the weight of the coke would also be removed, giving a total of 1.375% of the weight of the coke removed. This would leave 98.625% of the total weight of the original sulfur bearing coke as desulfurized coke.

Under experimental conditions, the actual results closely approach those expected. Approximately 1.5% to 1.7% of the total weight of the coke is lost for each 1% of sulfur removed. Thus to remove sulfur which makes up 10% of the coke by weight, approximately 15% to 17% of the total weight will be removed. In terms of weight, to desulfurize one ton (2000 lbs.) of coke containing 2% by weight (40 lbs.) of sulfur, about 24 lbs. of carbon will also be removed yeilding 1936 lbs. of desulfurized coke.

Although the sulfur vapor appears to preferentially react with the sulfur-carbon complexes to form carbon disulfide, if there is an excess of sulfur vapor present, the sulfur will react with the unbonded carbon in the coke to produce additional carbon disulfide. Since it is not the purpose of the invention to produce carbon disulfide, any unnecessary consumption of carbon is wasteful and highly undesirable. The purpose of the invention, it should be remembered, is to produce a desulfurized coke for use as a fuel. The production of a minimum quantity of carbon disulfide incidental and normally unavoidable and must be regarded as merely a by-product.

To insure that excessive sulfur vapor is not present, the sulfur vapor is diluted to a substantial extent by the carrier gas. It has been found that the best reaction control is obtained when the sulfur vapor is kept between 1% and 10% by volume of the sulfur vapor-carrier gas mixture, with the preferred concentration of sulfur vapor being between 2% and 3%. When larger concentrations of sulfur vapor are used, some of the sulfur reacts with unbonded carbon, as explained above, to form carbon disulfide. Also, with larger concentrations of sulfur, the carbon disulfide reaction proceeds rapidly so that it is difficult to stop the reaction at the point at which the constituent sulfur in the coke is substantially all consumed. If the reaction continues beyond the point at which the sulfur in the coke is consumed, carbon disulfide will continue to be produced on the basis of the supplied sulfur and the unbonded carbon in the coke. This, obviously, creates the same problem as an excess of sulfur vapor and unnecessarily consumes the carbon in the coke.

It is also important for the reaction to be carried out in an inert (except for the sulfur vapor) atmosphere. If other active elements are present, the carbon will react and further reduce the amount of coke output. If oxygen is present, for example, products such as COS, CO, $SO_2$, and $CO_2$ will be formed.

The carbon disulfide gas produced by the reaction taking place in reaction chamber 10 rises in the chamber with the carrier gas and is drawn off at or near the top, for example through an outlet port 18. Liquid carbon disulfide is recovered by passing the $CS_2$ gas and the carrier gas through a condenser-absorber 19.

The art of recovering carbon disulfide is well developed and in use in the coke industry (carbon disulfide is given off in the normal production of coke). The carbon disulfide product is useful in the plastic and rubber industries, as well as being a starting material for the production of various sulfur chemicals and sulfuric acid.

The stripped carrier gas is advantageously recycled through the reaction vessel, as indicated.

After initial start up and operation for the period of time necessary to remove polluting sulfur from the coke, a portion of so-treated coke should be removed through exit port 14 and an equal portion added through entryway 12. Operation of the apparatus may be such that small amounts of coke are withdrawn at frequent intervals or may be such that relatively larger amounts are withdrawn at longer intervals.

The temperature of the coke upon discharge from the cooling chamber will be appreciably lower than the reaction temperature, but may still be several hundred degrees Fahrenheit. It should be realized that the coke in the cooling chamber at start up will not be desulfurized and should be recycled.

In addition to cooling the coke in the cooling chamber, the carrier gas dilutes the applied sulfur vapor, as explained above, so that no more carbon from the coke will be converted to carbon disulfide than is necessary to accomplish the purposes of the invention. In addition, the carrier gas provides for more even distribution of the applied sulfur vapor through the coke.

It will be obvious that many other types of apparatus may be used to carry out the invention and that the process could even be carried out in a coking furnace after the coking process has been completed or the hot coke could be transferred to apparatus similar to that here illustrated while the coke is still hot from the coking process, thus saving heat.

It has been found that the carbon-disulfide-forming reaction will effectively take place within a range of from about 1150° F to the dissociation temperature of carbon disulfide, which is approximately 3000° F., the preferable range in most instances being between about 1800° and 2200° F. Operating temperature in any given instance will depend upon the prior history of the coke, e.g. the temperature at which coking took place and the nature of the coking process, and also on the composition of the coke.

Experiments demonstrating the process were conducted in an apparatus comprising a horizontal quartz tube and an electric resistance furnace surrounding the center portion of the tube. Coke samples were placed in the portion of the tube surrounded by the furnace, porous silica plugs being placed on either side of the sample. Powdered sulfur was placed in a portion of the tube outside the furnace. Nitrogen gas was passed through the tube. The coke was heated to a reaction temperature of 2000° F. Once the coke was at reaction temperature, the portion of the tube containing the sulfur was heated with a bunsen burner to vaporize the sulfur. The sulfur vapor was carried by the nitrogen carrier gas through the heated coke.

The process of the invention was carried out on a number of coke samples for different periods of time. Each timed run was made with a fresh sample of coke. The results are shown in the following tables.

TABLE 1

| Petroleum Coke from Union Oil Co.'s Santa Maria, Calif. Plant with combustible sulfur content of 6.33%, 20 gram samples | | |
|---|---|---|
| REACTON TIME | % COMBUSTIBLE SULFUR REMAINING IN REMAINING COKE | % COMBUSTIBLE SULFUR REMOVED FROM COKE |
| 5 Minutes | 6.28 | 0.84 |
| 15 Minutes | 3.82 | 39.65 |
| 25 Minutes | 1.15 | 81.83 |
| 30 Minutes | 0.65 | 89.73 |

TABLE 2

| Coal Coke from Geneva Steel Export Batch with Combustible sulfur content of 2.37%, 10 gram samples | | |
|---|---|---|
| REACTION TIME | % COMBUSTIBLE SULFUR REMAINING IN REMAINING COKE | % COMBUSTIBLE SULFUR REMOVED FROM COKE |
| 5 Minutes | 2.35 | 0.84 |
| 10 Minutes | 2.24 | 5.48 |
| 15 Minutes | 1.38 | 41.77 |
| 20 Minutes | 0.62 | 73.84 |
| 25 Minutes | 0.38 | 83.97 |
| 30 Minutes | 0.24 | 89.88 |
| 60 Minutes | 0.03 | 98.74 |

The percentage of sulfur indicated as remaining in the coke is the percentage of sulfur in the coke that remains after the reaction. Thus, after the reaction the coke that remains has the indicated percentage of sulfur. Less than 5% more coke as explained above, was consumed in the reaction than was stoichiometrically necessary for the complete removal, as carbon disulfide, of the sulfur in the coke.

As can be seen from the tables, almost 90% of the combustible sulfur content of the coke is removed within 30 minutes with over 98% being removed within one hour.

It is anticipated that homolougs of sulfur such as selenium and tellurium could be used in place of sulfur for the removal of the combined sulfur. There is presently no known commercial value to the production of selenium or tellurium sulfur compounds in large quantities.

Whereas the invention has been described herein with reference to the presently contemplated best mode of carrying it out, and has been described with reference to a particular apparatus which may be used, it should be understood that various changes may be made in the procedure and that a wide variety of apparatus may be used without departing from the disclosed inventive concepts particularly pointed out and claimed hereinafter.

I claim:

1. A process of desulfurizing sulfur-bearing coke, comprising the steps of heating a sulfur-bearing coke; passing a diluted elemental sulfur vapor through the heated coke, the temperature of the coke being such that said sulfur vapor will react with the sulfur compounds and complexes in the combustible portion of the coke to form carbon disulfide, which reaction thereby removes sulfur values originally carried by the combustible portion of said coke; controlling the reaction time so that the reaction will not continue substantially beyond the time that sulfur values originally carried by the combustible portion of said coke have been consumed; controlling the reaction environment so that the sulfur vapor is the only active element present and recovering the desulfurized coke.

2. A process according to claim 1, wherein the elemental sulfur vapor is diluted with an inert gas to a concentration by volume in the range of about 1% to 10% sulfur vapor.

3. A process according to claim 2, wherein the elemental sulfur vapor is diluted with an inert gas to a concentration by volume in the range of about 2% to 3% sulfur vapor.

4. A process according to claim 3, wherein the inert gas is nitrogen.

5. A process according to claim 1, wherein the coke is heated to a temperature in the range of about 1150° F. to about 3000° F.

6. A process according to claim 5, wherein the coke is heated to a temperature in the range of about 1800° F. to about 2200° F.

* * * * *